US005680037A

United States Patent [19]

Carobolante

[11] Patent Number: 5,680,037

[45] Date of Patent: Oct. 21, 1997

[54] HIGH ACCURACY CURRENT MIRROR

[75] Inventor: Francesco Carobolante, Portola Valley, Calif.

[73] Assignee: SGS-Thomson Microelectronics, Inc., Carrollton, Tex.

[21] Appl. No.: 330,431

[22] Filed: Oct. 27, 1994

[51] Int. Cl.[6] ..... G05F 3/16

[52] U.S. Cl. ..... 323/315; 323/316; 307/55

[58] Field of Search ..... 323/315, 316; 307/55

[56] References Cited

U.S. PATENT DOCUMENTS 4,573,021 2/1986 Widlar ..... 330/273

4,788,478 11/1988 Ishii et al. ..... 318/345

5,136,293 8/1992 Matsuo et al. ..... 323/316

5,325,045 6/1994 Sundby ..... 323/316

5,469,111 11/1995 Chiu ..... 327/538

*Primary Examiner*—Stuart N. Hecker

*Attorney, Agent, or Firm*—David V. Carlson; Theodore E. Galanthay; Lisa K. Jorgenson

[57] ABSTRACT

A current mirror uses an operational amplifier to control the collector voltage of two mirroring transistors during operation. The operational amplifier is coupled to the collector of each mirroring transistor such that a differential in voltage between the collector will produce an output voltage which drives a MOS transistor. The MOS transistor, responsive to the output of the operational amplifier, adjusts the voltage at the collector of one of the mirroring transistors to restore equilibrium.

33 Claims, 2 Drawing Sheets

HIGH ACCURACY CURRENT MIRROR

TECHNICAL FIELD OF THE INVENTION

This invention relates in general to electronic circuits, and more particularly to a high accuracy current mirror.

BACKGROUND OF THE INVENTION

The use of current mirrors in electronic circuits is very common. A current mirror generates an output current, $I_{out}$, based on a input current, $I_{in}$. In many cases, the accuracy of the current mirror is extremely important to the circuit design. An accurate current mirror will maintain the relationship $I_{in}=K \cdot I_{out}$, where K is a desired constant. In some cases, $I_{in}$ may vary over a small range, while in other cases $I_{in}$ may vary over a wide range.

Current mirror circuits use a pair of mirroring transistors with connected bases (or gates for MOS transistors) to generate the mirrored current. Assuming that the mirroring transistors are the same size, the input current $I_{in}$ will force a base current ($I_B$) in the input-side transistor according to the relationship $I_{in}=\beta I_B$. Assuming that the collector voltages of the mirroring transistors are equal (for PNP mirroring transistors), the same base current will drive the output side transistor, creating an output current of $I_{out}=\beta I_B=I_{in}$. However, as $I_{in}$ varies, $I_{out}$ will also vary, which may affect the collector voltage of the output side transistor. Consequently, a mismatch between collector voltages will result in a variation of base currents driving the two transistors, resulting in a mismatch between $I_{in}$ and $I_{out}$. The collector voltage mismatch may also be caused by other factors relating the operation of the circuit to which the current mirror is attached.

Additional factors may also affect the accuracy of the current mirror. A well-known error occurs when one of the mirroring transistors also acts as a sink for the base current. This is commonly referred to as base current error. Mismatches between the base-emitter voltages of the transistors can also contribute to output errors; the base-emitter voltage differences are typically cured by coupling resistors between the emitters and the voltage rail.

Many circuits require that a current mirror provide a linear ($I_{out}=K \cdot I_{in}$) relationship over a wide variation of $I_{in}$. Therefore, a need has arisen in the industry for a current mirror which displays linear response with little or no offset over a wide range of current.

SUMMARY OF THE INVENTION

The present invention provides a current mirror for providing a current output responsive to the current provided by an input current source. A first mirroring transistor passes current responsive to the input current source. A second mirroring transistor, coupled to said first mirroring transistor, passes current responsive to the current passed by the first mirroring transistor. Circuitry is provided for equalizing the voltage on the first and second mirroring transistors such that said first and second transistors accurately pass current in a predetermined ratio.

The present invention provides significant advantages over the prior art, particularly in applications which need a highly accurate current mirror. By equalizing the voltages of the transistors during operation of the circuit to which the mirror is coupled, the accuracy of the current mirror will not degrade as the voltage at the output node changes. Hence, the current mirror can be accurate over a wide range of input currents, despite voltages changes at the output node caused by changes in the input current.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
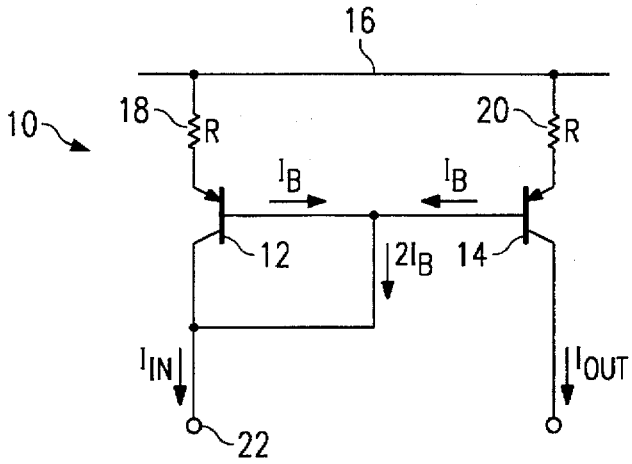
FIG. 1 (PRIOR ART)
FIG. 1 is a schematic representation of a first prior art current mirror circuit.

FIG. 1 illustrates a simple prior art current mirror 10. The current mirror 10 comprises two PNP transistors 12 and 14 with the emitters of the transistors 12 and 14 coupled to a voltage rail 16 through resistors 18 and 20. The bases of the transistors 12 and 14 are coupled to each other and to the collector of transistor 12. $I_{in}$ is taken from a node 22 coupled to the collector of transistor 12 and the bases of transistors 12 and 14 and $I_{out}$ is taken from a node coupled to the collector of transistor 14.

It should be noted that for simplicity, the current mirror 10 of FIG. 1 is assumed to have transistors of equal size and the resistors 18 and 20 are of equal resistive value. Under these conditions, in response to a given $I_{in}$, the base currents ($I_B$) from the transistors 12 and 14 will be equal. Under ideal conditions, the current through the collector ($I_C$) of each transistor 12 and 14 will be equal to $\beta I_B$. However, $I_{in}=I_C+2I_B=(\beta+2)I_B$. Since $I_{out}=I_C=\beta I_B$, the input and output currents are not identical.

Figure 2:
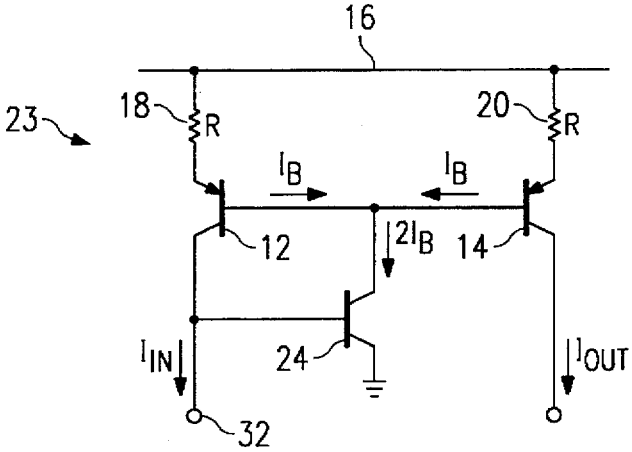
FIG. 2 (PRIOR ART)
FIG. 2 is a schematic representation of a is a second prior art current mirror circuit.

FIG. 2 illustrates a prior art current mirror 23 which reduces the effect of the base current of the PNP transistors 12 and 14 on $I_{in}$. In this case, the bases of the transistors 12 and 14 are coupled to the emitter of PNP transistor 24. The base of transistor 24 is coupled to the collector of transistor 12 and the collector of transistor 24 is coupled to ground. Hence, $I_{in}=I_C+(2/\beta)\ I_B=(\beta+2/\beta)\ I_B$. Thus, the differential in current between $I_{in}$ and $I_{out}$ is reduced by a factor of $\beta$ from the current mirror 10 of FIG. 2.

Figure 3:
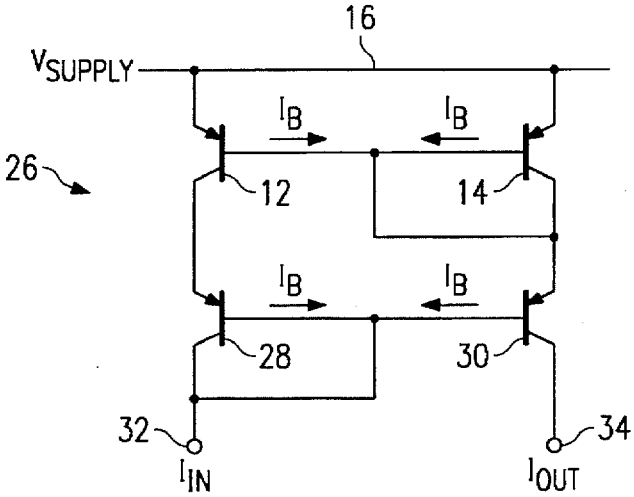
FIG. 3 (PRIOR ART)
FIG. 3 is a schematic representation of a is a third prior art current mirror circuit.

FIG. 3 illustrates another prior art current mirror 26 wherein a second pair of transistors 28 and 30 are coupled to transistors 12 and 14, respectively. The emitter of transistor 28 is coupled to the collector of transistor 12 and the emitter of transistor 30 is coupled to the collector of transistor 14. The bases of transistors 28 and 30 are coupled together. The collector of transistor 28 is coupled to the bases of transistors 28 and 30. $I_{in}$ is taken from a node 32 coupled to the collector of transistor 28 and to the bases of transistors 28 and 30. $I_{out}$ is coupled to a node 34 coupled to the collector of transistor 30. The current mirror shown in FIG. 3 reduces the difference in currents between $I_{in}$ and $I_{out}$ by a factor of $1/\beta$ from the circuit of FIG. 1.

While the current mirror of FIG. 3 does not create a mismatch between the voltages of the collectors at the output nodes by itself, when used in a circuit, the voltage at the output node may change during operation of the system. Often, a change in the input current will result in a change of the voltage at the output node. The mismatch in voltages at the input and output node will affect the current through the respective transistors 28 and 30, resulting in an error between $I_{in}$ and $I_{out}$, which varies with $I_{in}$.

Figure 4:
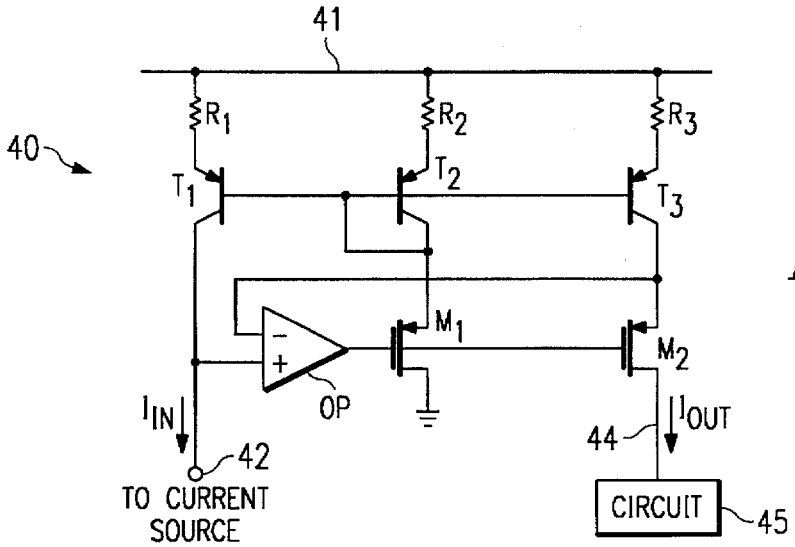
FIG. 4 is a schematic representation of a preferred embodiment of a current mirror according to the present invention.

A preferred embodiment of the current mirror of the present invention, using PNP transistors as the mirroring transistors, is illustrated in FIG. 4. The current mirror 40 comprises PNP transistors $T_1$, $T_2$ and $T_3$ having emitters coupled to a voltage rail 41 through resistors $R_1$, $R_2$ and $R_3$, respectively. The bases of the transistors $T_1$, $T_2$ and $T_3$ are coupled to one another and to the collector of $T_2$. The collector of $T_1$ is coupled to the non-inverting node of operational amplifier OP and to the input node 42. The collector of $T_2$ is coupled to the source of p-channel MOS transistor $M_1$. The drain of transistor $M_1$ is coupled to ground. The collector of $T_3$ is coupled to the source of p-channel MOS transistor $M_2$ and to the inverting input of operational amplifier OP. The drain of p-channel transistor $M_2$ is the output node 44 of the current mirror 40. The output node 44 is coupled to a circuit 45.

In operation, the current mirror 40 receives current from a current source coupled to the input node 42. The current from the current source may be at a constant magnitude or may be varying. The current mirror provides an output current through output node 44 which mirrors the input current. The output current is received by circuit 45. During operation of the current mirror 40 and circuit 45, the voltage at output node 44 may vary.

For a current mirror in which $I_{out}=I_{in}$, $T_1$ and $T_3$ are of identical size (typically $T_2$ will also be the same size) and $R_1$, $R_2$ and $R_3$ have the same resistive value. Since $I_{in}=\beta I_B$ (where $I_B$ is the same for each transistor), the current at the collector of $T_3$ will also be $\beta I_B$ so long as the voltage at the collectors of both $T_1$ and $T_3$ remains the same. Operational amplifier OP is a differential amplifier which produces an output proportional to the difference of the collector voltage of $T_3$ and the collector voltage of $T_1$. When the voltage at the collector of $T_3$ is greater than the voltage at the collector of $T_1$, operational amplifier OP generates a negative voltage equal to $G(V_{C1}-V_{C3})$, where G is the gain of the operational amplifier, $V_{C1}$ is the voltage at the collector of $T_1$ and $V_{C3}$ is the voltage at the collector of $T_1$. The negative voltage at the output of OP is applied to the gate of $M_2$, thereby lowering the $V_{C3}$. The voltage at the output of OP will adjust until $V_{C1}=V_{C3}$.

Consequently, the operational amplifier OP forces the collectors of $T_1$ and $T_3$ to the same voltage during operation of the circuit to which the current mirror 40 is attached. The operational amplifier OP should have a small input bias and offset currents to prevent the operational amplifier from affecting the $I_{in}$ or $I_{out}$ currents. In general, a higher gain is preferred for a more accurate circuit, subject to other design considerations. Further, $M_2$ should be a MOS device, as opposed to bipolar, to avoid any base current error.

Transistors $M_1$ and $T_2$ pass the base current of transistors $T_1$ and $T_3$ to ground without adding any base current error to $I_{out}$. In the preferred embodiment, the ratio of width to length of $M_2$ is greater than or equal to the width to length ratio of $M_1$. This ensures that the gate-source voltage drop across $M_1$ is greater than the gate-source voltage drop across $M_2$. Hence $V_{C3}<V_{C2}$, which keeps $T_3$ away from saturation. The width to length ratio of $M_2$ will depend upon the current to be supplied by the current mirror. In general, a larger current will require a larger W/L ratio for $M_2$.

Figure 5:
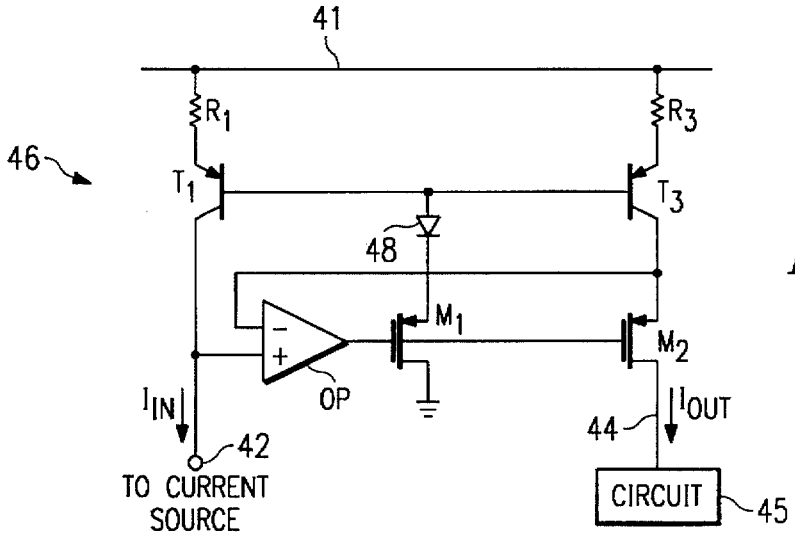
FIG. 5 is a schematic representation of a second preferred embodiment of a current mirror according to the present invention.

The current path provided by $M_1$ and $T_2$ could be provided in a number of different ways without affecting the operation of the current mirror 40. For example, FIG. 5 illustrates a schematic representation of a current mirror 46 similar to that shown in FIG. 4, with the exception that $T_2$ is replaced by a diode 48 coupled between the bases of $T_1$ and $T_3$ and the source of p-channel transistor $M_1$.

Figure 6:
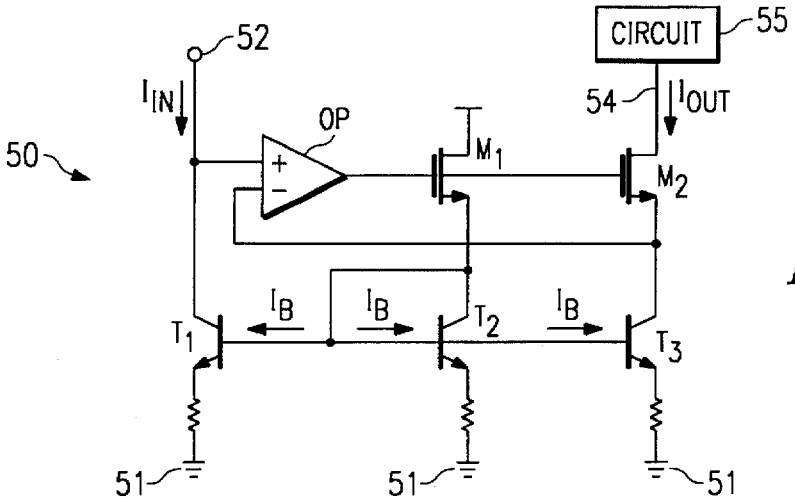
FIG. 6 is a schematic representation of a current mirror according to the present invention using NPN mirroring transistors.

A preferred embodiment of the current mirror of the present invention, using NPN transistors as the mirroring transistors, is illustrated in FIG. 6. The current mirror 50 comprises NPN transistors $T_1$, $T_2$ and $T_3$ having emitters coupled to a voltage rail (ground) 51 through resistors $R_1$, $R_2$ and $R_3$, respectively. The bases of the transistors $T_1$, $T_2$ and $T_3$ are coupled to one another and to the collector of $T_2$. The collector of $T_1$ is coupled to the non-inverting node of operational amplifier OP and to the input node 52. The collector of $T_2$ is coupled to the source of n-channel MOS transistor $M_1$. The drain of transistor $M_1$ is coupled to a voltage rail. The collector of $T_3$ is coupled to the source of n-channel MOS transistor $M_2$ and to the inverting input of operational amplifier OP. The drain of n-channel transistor $M_2$ is the output node 54 of the current mirror 50. The output node 54 is coupled to a circuit 55.

The operation of current mirror 50 is similar to that of current mirror 40 of FIG. 4. The current mirror 50 receives current from a current source coupled to the input node 52. The current from the current source may be at a constant magnitude or may be varying. The current mirror 50 provides an output current through output node 54 which mirrors the input current. The output current is received by circuit 55. During operation of the current mirror 50 and circuit 55, the voltage at output node 54 may vary. When $V_{C1}<>V_{C3}$, operational amplifier OP adjusts the voltage drop across $M_2$ until the collector voltages are equal. Consequently, the operational amplifier OP forces the collectors of $T_1$ and $T_3$ to the same voltage during operation of the circuit to which the current mirror 50 is attached. $M_1$ sources current to the bases of transistors $T_1$, $T_2$ and $T_3$.

Although the Detailed Description of the invention has been directed to certain exemplary embodiments, various modifications of these embodiments, as well as alternative embodiments, will be suggested to those skilled in the art. For example, while described as a unity gain current mirror, the device could provide any ratio of $I_{in}/I_{out}$ as desired.

The invention encompasses any modifications or alternative embodiments that fail within the scope of the Claims.

What is claimed is:

1. A current mirror, comprising:

an input current source;

a first mirroring transistor for passing a first current responsive to said current source, said first transistor having a first node coupled to said current source;

a second mirroring transistor, coupled to said first mirroring transistor, for passing a second current responsive to said first current, said second transistor having a second node for providing said second current; and circuitry for equalizing the voltages on said first and second nodes such that said first and second transistors pass said first and second currents in a predetermined ratio.

2. The current mirror of claim 1 wherein said equalizing circuitry comprises:

a differential amplifier having a pair of input terminals respectively coupled to said first and second nodes, said differential amplifier for outputting a voltage dependent upon the voltage at said first and second nodes of said first and second mirroring transistors; and a MOS transistor driven by the output of said differential amplifier, said MOS transistor coupled to said second node.

3. The current mirror of claim 1 wherein said first mirroring transistor comprises a first PNP transistor having a collector as said first node, and said second mirroring transistor comprises a second PNP transistor having a collector as said second node, such that said equalizing circuitry equalizes the voltages at said collectors of said first and second mirroring transistors.

4. The current mirror of claim 1 wherein said first mirroring transistor comprises a first NPN transistor having a collector as said first node, and said second mirroring transistor comprises a second NPN transistor having a collector as said second node, such that said equalizing circuitry equalizes the voltages at said collectors of said first and second mirroring transistors.

5. The current mirror of claim 1 wherein said first and second transistors are bipolar transistors having connected bases, and further comprising a third transistor for adjustably coupling said bases to a predetermined voltage.

6. The current mirror of claim 5 wherein said third transistor is a MOS transistor.

7. A current mirror, comprising:

an input current source:

a first mirroring transistor for passing current responsive to said current source;

a second mirroring transistor, coupled to said first mirroring transistor, for passing current responsive to the current passed by said first mirroring transistor;

circuitry for equalizing the voltage on said first and second mirroring transistors such that said first and second transistors pass current in a predetermined ratio, said circuitry including a differential amplifier for outputting a voltage dependent upon the voltage at respective nodes of said first and second mirroring transistors and including a MOS transistor driven by the output of said differential amplifier.

8. The current mirror of claim 7 wherein said MOS transistor is coupled between said second mirroring transistor and an output current node.

9. A current mirror, comprising:

an input current source;

a first mirroring transistor for passing current responsive to said current source;

a second mirroring transistor, coupled to said first mirroring transistor, for passing current responsive to the current passed by said first mirroring transistor;

circuitry for equalizing the voltage on said first and second mirroring transistors such that said first and second transistors pass current in a predetermined ratio; and wherein said mirroring transistors are PNP transistors, each having a base, collector and emitter, and wherein said equalizing circuitry equalizes the voltages at the collectors of said first and second mirroring transistors.

10. A current mirror, comprising:

an input current source;

a first mirroring transistor for passing current responsive to said current source;

a second mirroring transistor, coupled to said first mirroring transistor, for passing current responsive to the current passed by said first mirroring transistor;

circuitry for equalizing the voltage on said first and second mirroring transistors such that said first and second transistors pass current in a predetermined ratio; and wherein said first and second mirroring transistors are NPN transistors, each having a base, collector and emitter, and wherein said equalizing circuitry equalizes the voltages at the collectors of said first and second mirroring transistors.

11. A method of generating current to a circuit, comprising the steps of:

passing current through a first mirroring transistor responsive to a current source;

passing current through a second mirroring transistor coupled to said first mirroring transistor responsive to the current passed by said first mirroring transistor; and equalizing the voltage on said first and second mirroring transistors such that said first and second transistors pass a current in a predetermined ratio, said equalizing including outputting a voltage from a differential amplifier in a magnitude dependent upon the voltage at respective nodes of said first and second mirroring transistors and includes driving a MOS transistor by the output of said differential amplifier.

12. The method of claim 11 wherein said driving a MOS transistor comprises driving a MOS transistor coupled between said second mirroring transistor and an output current node.

13. A method of generating current to a circuit, comprising the steps of:

passing current through a first mirroring transistor responsive to a current source;

passing current through a second mirroring transistor coupled to said first mirroring transistor responsive to the current passed by said first mirroring transistor;

equalizing the voltage on said first and second mirroring transistors such that said first and second transistors pass current in a predetermined ratio;

wherein said mirroring transistors are PNP transistors, each having a base, collector and emitter; and wherein said equalizing includes equalizing the voltages at the collectors of said first and second mirroring transistors.

14. A method of generating current to a circuit, comprising the steps of:

passing current through a first mirroring transistor responsive to a current source;

passing current through a second mirroring transistor coupled to said first mirroring transistor responsive to the current passed by said first mirroring transistor;

equalizing the voltage on said first and second mirroring transistors such that said first and second transistors pass current in .a predetermined ratio;

wherein said first and second mirroring transistors are NPN transistors, each having a base, collector and emitter; and said equalizing includes equalizing the voltages at the collectors of said first and second mirroring transistors.

15. A method, comprising:

receiving an input current at a high-impedance node of a first transistor that also has a control node, said high-impedance node at a first voltage;

providing an output current from a high-impedance node of a second transistor that has a control node that is coupled to said control node of said first transistor, said high-impedance node of said second transistor at a second voltage; and maintaining the ratio of said output current to said input current substantially constant by maintaining said first voltage substantially equal to said second voltage.

16. The method of claim 15 wherein said maintaining comprises maintaining said ratio substantially equal to 1.

17. The method of claim 15 wherein said maintaining comprises controlling said second voltage to substantially equal said first voltage.

18. A current-mirror circuit, comprising:

an input node;

an output node;

a first reference node;

a first transistor having a first current terminal coupled to said input node, a second current terminal coupled to said reference node, and a control terminal;

a second transistor having a first current terminal, a second current terminal coupled to said reference node, and a control terminal coupled to said control terminal of said first transistor;

a third transistor having a first current terminal coupled to said output node, a second current terminal coupled to said first current terminal of said second transistor, and a control terminal; and a differential amplifier having a first input terminal coupled to said first current terminal of said first transistor, a second input terminal coupled to said first current terminal of said second transistor, and an output terminal coupled to said control terminal of said third transistor.

19. The current-mirror circuit of claim 18 wherein:

said first and second transistors respectively comprise first and second PNP transistors that each have a collector as said first current terminal, an emitter as said second current terminal, and a base as said control terminal; and said third transistor comprises a PMOS transistor that has a drain as said first current terminal, a source as said second current terminal, and a gate as said control terminal.

20. The current-mirror circuit of claim 18 wherein:

said first and second transistors respectively comprise first and second NPN transistors that each have a collector as said first current terminal, an emitter as said second current terminal, and a base as said control terminal; and said third transistor comprises an NMOS transistor that has a drain as said first current terminal, a source as said second current terminal, and a gate as said control terminal.

21. The current-mirror circuit of claim 18, further comprising:

a second reference node;

a fourth transistor having a first current terminal, a second current terminal coupled to said first reference node, and a control terminal coupled to said control terminals of said first and second transistors; and a fifth transistor having a first current terminal coupled to said second reference node, a second current terminal coupled to both said first current terminal and said control terminal of said fourth transistor, and a control terminal coupled to said output terminal of said differential amplifier.

22. The current-mirror circuit of claim 18, further comprising:

a second reference node;

a diode having a first terminal and having a second terminal coupled to said control terminals of said first and second transistors; and a fifth transistor having a first current terminal coupled to said second reference node, a second current terminal coupled to said first terminal of said diode, and a control terminal coupled to said output terminal of said differential amplifier.

23. The current-mirror circuit of claim 18, further comprising:

a second reference node;

said first and second transistors respectively being first and second PNP transistors that each have a collector as said first current terminal, an emitter as said second current terminal, and a base as said control terminal of said respective first and second transistors;

said third transistor being a PMOS transistor that has a drain as said first current terminal, a source as said second current terminal, and a gate as said control terminal of said third transistor;

a fourth PNP transistor having a collector, an emitter coupled to said first reference node, and a base coupled to said bases of said first and second transistors; and a fifth PMOS transistor having a drain coupled to said second reference node, a source coupled to said collector and said base of said fourth transistor, and a gate coupled to said output terminal of said differential amplifier.

24. The current-mirror circuit of claim 18, further comprising:

a second reference node;

said first and second transistors respectively being first and second NPN transistors that each have a collector as said first current terminal, an emitter as said second current terminal, and a base as said control terminal of said respective first and second transistors;

said third transistor being an NMOS transistor that has a drain as said first current terminal, a source as said second current terminal, and a gate as said control terminal of said third transistor;

a fourth NPN transistor having a collector, an emitter coupled to said first reference node, and a base coupled to said bases of said first and second transistors; and a fifth NMOS transistor having a drain coupled to said second reference node, a source coupled to said collector and said base of said fourth transistor, and a gate coupled to said output terminal of said differential amplifier.

25. A method of generating current to a circuit, comprising the steps of:

providing current to an input node of a first mirroring transistor in response to a current source;

supplying current from an output node of a second mirroring transistor that is coupled to said first mirroring transistor in response to the current provided to said first mirroring transistor; and equalizing the voltages on said input and output nodes of said first and second mirroring transistors, respectively, such that said first and second transistors pass current in a predetermined ratio.

26. The method of claim 25 wherein said equalizing step comprises controlling said voltage on said output node in response to a voltage from a differential amplifier, said voltage from said differential amplifier having a magnitude dependent upon said voltages at said input and output nodes.

27. The method of claim 26 wherein said controlling comprises driving a MOS transistor with said voltage from said differential amplifier, said MOS transistor coupled to said output node of said second transistor.

28. The method of claim 25 wherein said first mirroring transistor comprises a first PNP transistor having a collector as said input node, and said second mirroring transistor comprises a second PNP transistor having a collector as said output node, said equalizing comprising equalizing the voltages at said collectors of said first and second mirroring transistors.

29. The method of claim 25 wherein said first mirroring transistor comprises a first NPN transistor having a collector as said input node, and said second mirroring transistor comprises a second NPN transistor having a collector as said output node, said equalizing comprising equalizing the voltages at said collectors of said first and second mirroring transistors.

30. The method of claim 25 wherein said first and second transistors are bipolar transistors having connected bases, and further comprising the step of sinking current from said bases.

31. The method of claim 30 wherein said sinking step comprises sinking current from said bases through a MOS transistor.

32. The method of claim 25 wherein said first and second transistors are bipolar transistors having connected bases, and further comprising the step of sourcing current to said bases.

33. The method of claim 32 wherein said sinking step comprises sourcing current to said bases through a MOS transistor.

* * * * *